US006758732B1

(12) United States Patent
Hilton

(10) Patent No.: US 6,758,732 B1
(45) Date of Patent: Jul. 6, 2004

(54) BACKING PLATE AND DISC CONFIGURED FOR BLOWING ANGLED GRINDING

(76) Inventor: Mark A. Hilton, 28103 Redwood La., Lebanon, MO (US) 65536

( * ) Notice: Subject to any disclaimer, the term of this patent is extended or adjusted under 35 U.S.C. 154(b) by 0 days.

(21) Appl. No.: 10/306,965

(22) Filed: Nov. 30, 2002

Related U.S. Application Data

(60) Provisional application No. 60/384,490, filed on May 31, 2002, and provisional application No. 60/335,258, filed on Dec. 1, 2001.

(51) Int. Cl.[7] ..... B24B 41/00

(52) U.S. Cl. ..... 451/360; 451/177; 451/178; 451/186; 451/345; 451/359

(58) Field of Search ..... 451/177, 178, 451/186, 345, 359, 360

(56) References Cited

U.S. PATENT DOCUMENTS

| | | | | |
|---|---|---|---|---|
| 407,248 | A | 7/1889 | Rogers | |
| 503,258 | A | 8/1893 | Stanbrough | |
| 506,350 | A | 10/1893 | Towne | |
| 604,051 | A | 5/1898 | Keighley | |
| 617,233 | A | 1/1899 | de Wolfe | |
| 1,308,093 | A | 7/1919 | Merritt | |
| 1,700,634 | A | 1/1929 | Hopf | |
| 2,186,402 | A | 1/1940 | Bowen | |
| 2,728,174 | A | 12/1955 | Mastrandrea | |
| 2,749,681 | A | 6/1956 | Reidenbach | |
| 3,340,652 | A | 9/1967 | Purcell, Jr. | |
| 4,245,438 | A | 1/1981 | van Buren, Jr. | |
| 5,494,368 | A * | 2/1996 | Matthews | 403/259 |
| 5,938,514 | A | 8/1999 | Amin et al. | |
| 6,007,415 | A | 12/1999 | Van Osenbruggen | |
| 6,062,965 | A | 5/2000 | Knowlton | |
| 6,159,089 | A | 12/2000 | Amin et al. | |
| 6,277,012 | B1 | 8/2001 | Halliley | |
| 6,280,309 | B1 | 8/2001 | Van Osenbruggen | |
| 6,312,325 | B1 | 11/2001 | Van Osenbruggen | |

OTHER PUBLICATIONS

D.C. Greenwood, *Engineering Data for Product Design*, (McGraw–Hill) : New York 1961).
Section entitled "Lanced Metal eliminates separate fasteners," pp. 338–341.
U.S. Pat. App. Publ. No. 2002/0090900—Telischak et al., dated Jul. 11, 2002 (filed Jan. 10, 2001).
Product data on SpiralCool™ backing pad (undated) (1 sheet).
Packaging label for Avos® "See–Thu Sanding System," product No. 03061 of the Norton® Company. Worcester, Mass. (dated) (1 sheet).

* cited by examiner

*Primary Examiner*—Joseph J. Hail, III
*Assistant Examiner*—Shantese McDonald
(74) *Attorney, Agent, or Firm*—Jonathan A. Bay

(57) ABSTRACT

A combination abrasive disc and backing plate provide workpiece viewing and blowing collectively through aligned viewing apertures. The backing plate has a bottom surface adapted to support the abrasive disc and an opposed top surface. Coordinated alignment of the viewing apertures of the disc and plate allows observation of a workpiece collectively through the disc and plate during rotary drive thereof. The plate's viewing aperture is partially adjoined by a scoop formation on the plate's top surface. The scoop is arranged for deflecting air from above the plate's top surface and consequently forcing such in a current collectively through the aligned viewing apertures of the disc and plate. This blowing current acts to both blow away debris from the field of view and thereby reduce viewing impairment, as well as to provide some cooling to the workpiece.

18 Claims, 9 Drawing Sheets

T
60
65
62
64
66

F
60
20
22
72
76
70
74

BACKING PLATE AND DISC CONFIGURED FOR BLOWING ANGLED GRINDING

CROSS-REFERENCE TO PROVISIONAL APPLICATION(S)

This application claims the benefit of U.S. Provisional Application No. 60/384,490, filed May 31, 2002, and of U.S. Provisional Application No. 60/335,258, filed Dec. 1, 2001, both wich are incorporated herein by reference.

BACKGROUND AND OF THE INVENTION

The invention relates to abrading and handheld disc grinding or, more particularly, to a backing plate and disc cooperatively configured to allow an angled grinding operation on a given workpiece at the same time as blowing a strong current of air over the workpiece. The invention also relates to a coupling adapter for inserting between a handheld grinding tool and a disc/plate combination, as well as to a locking nut or fastener for securing a disc/plate combination in a given alignment.

A number of additional features and objects will be apparent in connection with the following discussion of preferred embodiments and examples.

SUMMARY OF THE INVENTION

It is an object of the invention to provide a combination backing plate and disc for blowing angled-grinding operations.

It is an alternate object of the invention to configure a backing plate with apertures and blowing vanes as well as configure the disc with matching apertures to accomplish the blowing service.

It is another object of the invention to configure the blowing vanes and apertures to permit a worker to view the workpiece therethrough.

It is a further object of the invention to provide a locking device for the inventive backing plate and disc such as a locking nut or fastener or the like, all three of which are cooperatively configured to increase the chances that a given alignment between the disc and backing plate is obtained.

It is an additional object of the invention to provide an adapter for extending the distance between the handheld grinding tool and the combination disc/backing plate for various purposes as explained more particularly below.

These and other aspects and objects are provided according to the invention in a blowing angled-grinding combination that accomplishes forced-air blowing away of debris from the point of operation on the workpiece as well as to provide forced-air cooling to the workpiece.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIGS. 7 through 9 are a series of comparable views showing the air currents developed by various spun abrading-disc configurations as described more particularly below, wherein:

FIG. 7 shows the mild, tangentially-ejected currents induced by a solid grinding disc in accordance with the prior art, FIG. 8 shows the moderate suction currents induced by an apertured ventilating disc in accordance with the prior art, and FIG. 9 shows the strong blowing currents forced by the combination backing pad and disc for blowing angled-grinding operations in accordance with the invention;

DETAILED DESCRIPTION OF THE PREFERRED EMBODIMENTS

Figure 1:
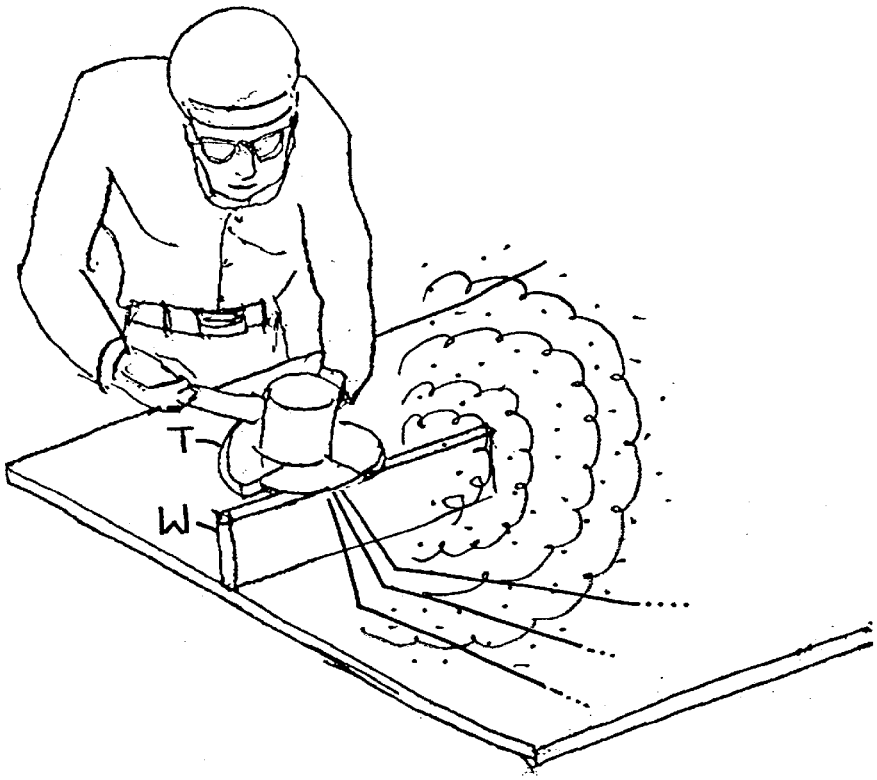
FIG. 1. (PRIOR ART)
FIG. 1 is a top perspective view of an angled grinding operation in accordance with the prior art, in which a worker manipulates a handheld grinding tool so that a peripheral edge of a rapidly-spun grinding disc attacks the workpiece at an angle.

FIG. 1 shows an angled grinding operation in accordance with the prior art. A worker manipulates a handheld grinding tool T so that a peripheral edge of a rapidly-spun grinding disc attacks the workpiece W at an angle. Grinding and sanding by discs are sufficiently different operations that it is worth reviewing their distinguishing aspects. To turn ahead to FIG. 7, it shows a prior art grinding disc which in contrast to FIG. 8, which shows a prior art sanding disc.

Figure 7:
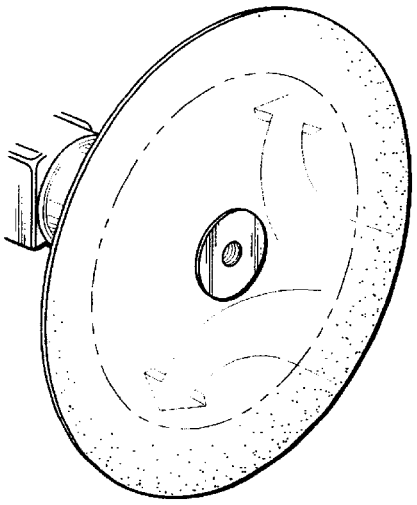
Fig. 7 (PRIOR ART)
Figure 8:
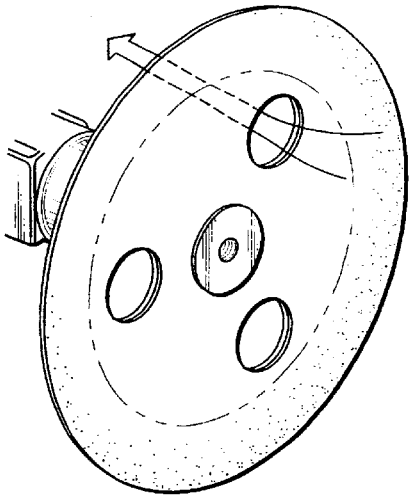
Fig. 8 (PRIOR ART)

Whereas FIG. 8 shows other features which will be more particularly described below, for present purposes FIGS. 7 and 8 can be compared to show the relative size of the disc to the backing plate.

In FIG. 7, the disc overhangs the backing plate by more than an inch or two (2.5 to 5.0 cm) or so for say a seven inch outside diameter (ø17.5 cm) grinding disc. Hence the backing plate is likely to measure merely about five inches in outside diameter (ø12.5 cm). In contrast, in FIG. 8, the sanding disc fairly matches in diameter the size of the backing plate. With angle grinding, only a short arc of the peripheral edge of the disc is trained on the workpiece as shown by FIG. 1. A sanding operation has a substantial fractional portion of the interior surface of the sanding disc in flat mating contact with the workpiece (this is not shown).

For grinding, it is indeed much preferred that the grinding disc has an enlarged size. That way, the grinding disc has a peripheral edge having a lengthier linear measure, which means longer wearability in use. Also, even though this practice is not really endorsed by original equipment manufacturers, it is indeed popular with workers to trim the edges of worn grinding discs to eke out more use. That is, all the wear takes place on the edge. After so much use the edge loses a lot of its grit and hence grinding isn't too effective. However, a worker can trim about a quarter-inch (0.5 cm) off the disc's periphery and pretty much make it like new.

FIG. 1 shows that grinding, in further contrast to sanding, produces great quantities of debris, varying from billowing clouds of fine dust to brief-lived miniature sparks rocketing away for short distances on projectile trajectories, possibly ricocheting.

Figure 2:
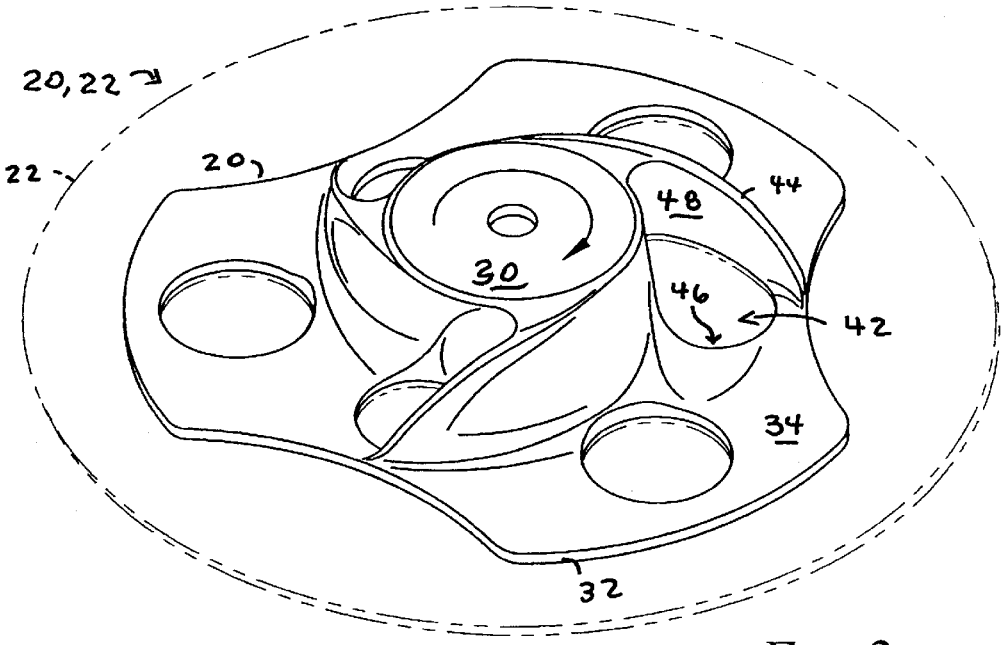
FIG. 2 is a top perspective view of a combination backing plate and disc in accordance with the invention, in which the underlying disc is depicted in dashed lines, for blowing angled-grinding operations.

FIG. 2 is a top perspective view of a combination backing plate 20 and disc 22 in accordance with the invention, for blowing angled-grinding operations. The underlying disc 22 is depicted in dashed lines for sake of simplicity in various views of the drawings including in FIG. 2. The backing plate 20 is preferably formed from a plastic or resinous material. The material ought optimally to be both tough but slightly flexible. The backing plate 20 is configured for mounting on, among other devices, the drive shaft output of a handheld shop tool T as shown for example by FIG. 1. In autobody shops as the inventor is most familiar with, one class of these type of shop tools typically are pneumatic and have a pistol-grip configuration.

Figure 3:
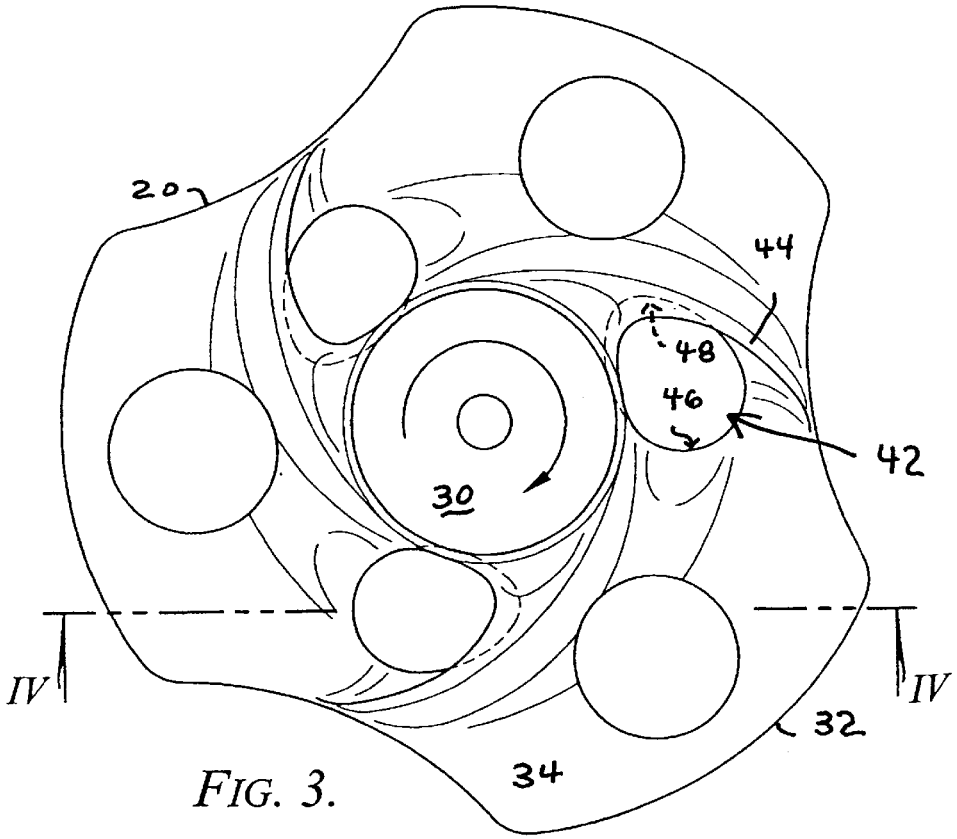
FIG. 3 is a top plan view of the backing plate of FIG. 2.
Figure 5:
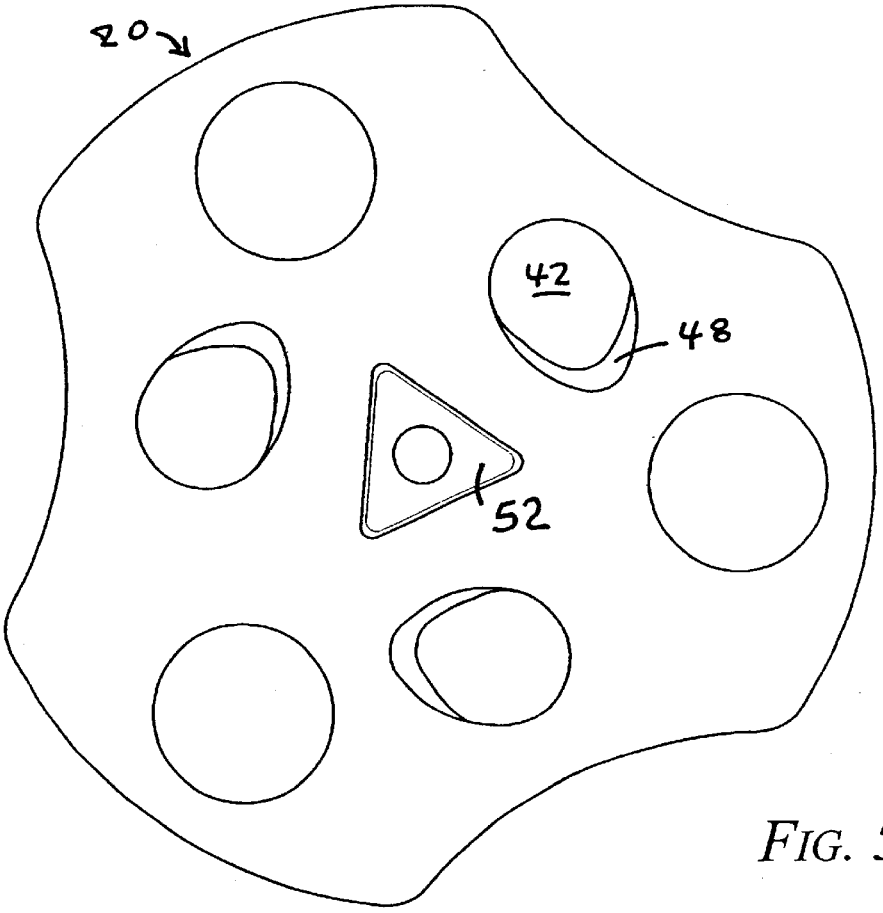
FIG. 5 is a bottom plan view of FIG. 3 or 4.
Figure 6:
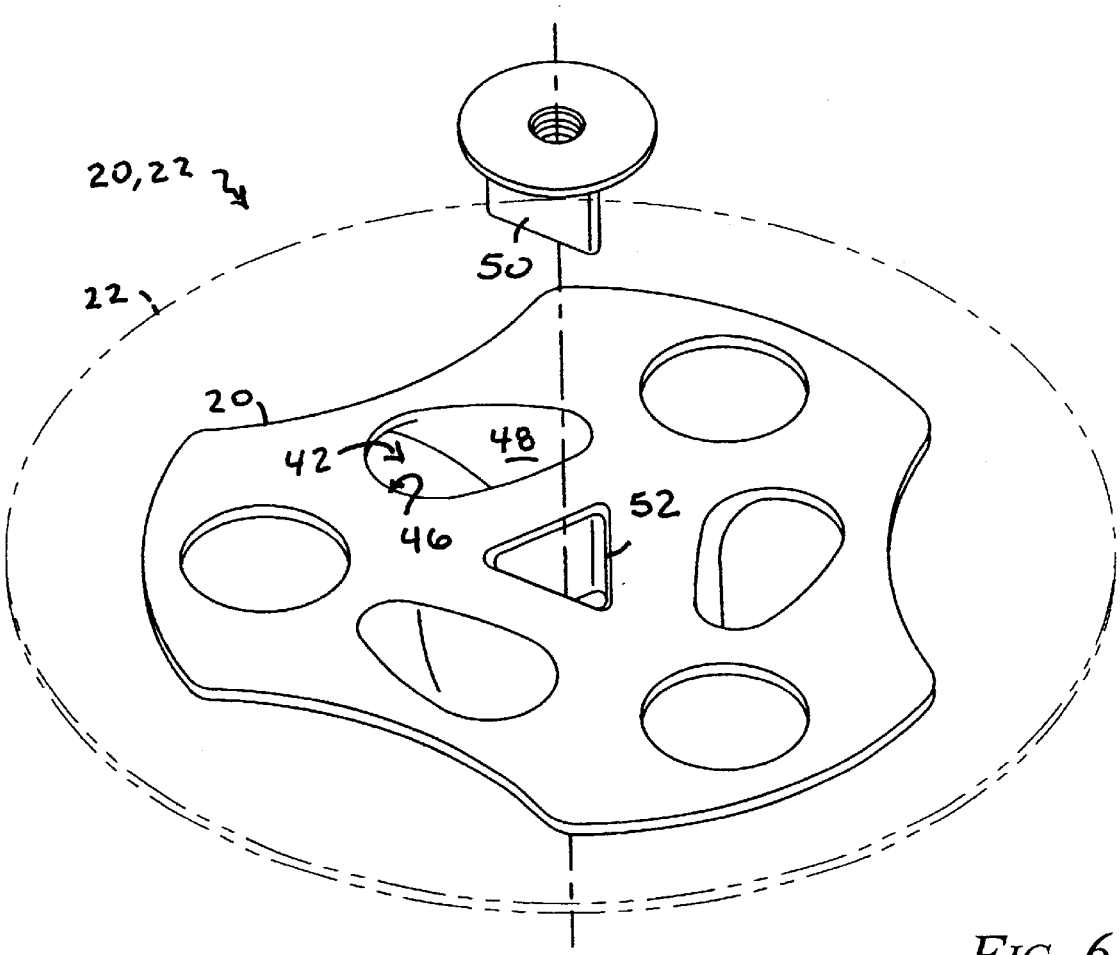
FIG. 6 is comparable to FIG. 2 except from a different vantage point to show a bottom perspective view of the backing plate and disc in accordance with the invention, in which the disc which is overlying this time is again shown in dashed lines, and including a locking nut therefor as shown aligned on the central axis thereof.

In the drawings, the terminology is adopted such that FIGS. 2 and 3 are said to show the "top" of the backing plate 20 in contrast to FIGS. 5 and 6 showing the "bottom." However, the backing plate 20 can be viewed as well as utilized in about any orientation, and accordingly, terms like "top" and "bottom" are used merely for convenience in this description and do not limit the invention.

Referencing FIG. 2 more particularly now, the backing plate 20 has an enlarged or "barreled" hub portion 30 and then, in the radial direction toward the termination in the peripheral edge 32, the plate gradually thins down to a given constant web thickness. For convenience of description, the backing plate 20 is hence reckoned as composed of a central hub portion 30 which merges gradually over a transition zone into an outer web portion 34. The peripheral edge 32 is formed with three scallops about 120° apart, which in effect give the peripheral edge 32 three lobes. The web portion 34 is inventively configured with at least one and optionally two series of apertures, in this case each series has three apertures apiece. One series comprises non-blowing apertures (not indicated by a reference numeral), while more significantly the other series comprises inventive blowing apertures 42. It is an inventive aspect of this backing plate 20 that certain ones 42 of the apertures—ie., referred to here on occasions as the blowing apertures 42—are surrounded in part by vanes 44 to catch air and force or "push" it out in a direction of blowing over the workpiece W (see, eg., FIG. 1).

More particularly, three of the apertures 42 are slightly ovoid, tapering to sharp ends. The backing plate 20 includes spirally-formed fences or vanes 44 curling about the sharp ends of the blowing apertures 42 from origins in the hub portion 30. FIGS. 2 and 3 include an arrow to show direction of turning. The vanes 44 are configured to catch air. Hence the blowing apertures 42 have a leading edge 46 and trailing edge, and it is the trailing edge which was just previously characterized as the sharp end. That is, the vanes or fences 44 curl around the trailing edge of the blowing aperture 42 to thrust air forwardly with considerable force. The plate 22's web portion 34 ahead of the leading edge 46 is preferably flat or rather un-featured to provide clearance for air. The trailing edge is surrounded by the vane 44, curling around it in part. The vane 44 catches the air that was given clearance ahead of the leading edge 46. FIG. 3 (or perhaps FIG. 4 better) shows that the vanes 44 are angled relative to the central axis in order to deflect or "force" air in the direction of the workpiece. FIG. 2 shows that the vanes 44 start at origins in the central hub 30, and thin as well as flatten out as the vanes curl or spiral out toward their terminations in the peripheral edge 32 in the lobe portions. FIG. 3 (or again perhaps FIG. 4 better) shows that the vanes 44 form a cooperative funnel portion 48 for funneling caught air through the blowing aperture 42's trailing end.

More general aspects of FIGS. 2 and 3 include the following. The three other, non-blowing apertures which are not combined with vanes. Hence these apertures simply provide a viewing function (they are also simply round). That is, while the plate and disc 20 and 22 are spinning, the non-blowing apertures allow viewing therethrough as partly disclosed in connection with U.S. Pat. No. 6,007,414 —Van Osenbruggen. However, in terms of the invention here, these other or non-blowing apertures are optional and can be omitted because, as FIG. 3 shows, the inventive blowing apertures 42 which are combined with the vanes 44 also create substantial windows to view therethrough.

Figure 4:
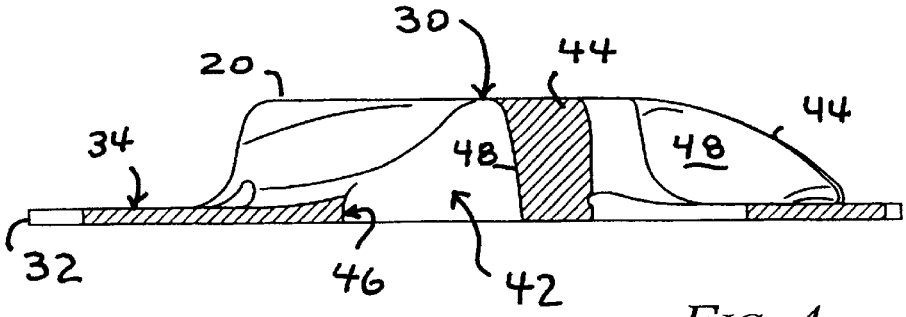
FIG. 4 is a section view taken along line IV—IV in FIG. 3.

FIG. 4 is a section view taken along line IV—IV in FIG. 3. FIG. 4 shows better that the funnel portion 48 of the vane 44 is angled slightly relative to the central axis of the backing plate 20. That is, in FIG. 4, if given the central axis corresponding to a vertical line, then the funnel portion 48 of the vane 44 is tilted about 5°–10° away from the vertical. That slight tilt of the funnel section 48 is sufficient to not only catch but also deflect, force or "push" air in the direction of the workpiece W (not shown in FIG. 4, but which would be in the downward direction in FIG. 4).

FIG. 5 is a bottom plan view of FIGS. 3 or 4. The bottom of the backing plate 20 is flat for supporting contact with the disc 22 (not shown in this view). FIG. 5 provides another look at the angled-funnel portions 48 of the vanes 44 for the blowing apertures 42.

FIG. 5 also shows that the backing plate 20 is formed with a triangular socket 52. To turn to FIG. 6, the invention preferably implements a locking methodology between the plate 20 and disc 22 which promotes correct alignment therebetween. One example way of accomplishing the foregoing is to provide a locking nut 50 with a triangular-block head. The disc 22 is cooperatively configured with a triangular central aperture (not shown). Hence the triangular-block head of the locking nut 50 inserts through the triangular aperture of the disc 22 and then nests into the triangular socket 52 of the backing plate 20. By these means, correct alignment between the disc 22 and plate 20 can be relatively ensured. That is, the disc 22 is formed with a corresponding pattern of six apertures as substantially identically shown by FIG. 5. It is noticed that the aperture pattern is angularly symmetric every 120°. Hence the triangular nut 50 and socket 52 promote correct alignment as the disc 22 and backing plate 20 are in relatively correct alignment every 120° of relative angular re-positioning therebetween.

Figure 9:
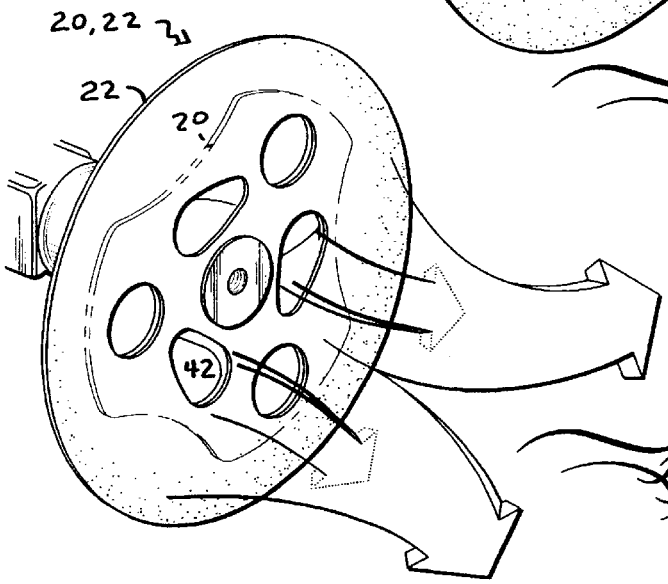

FIGS. 7 through 9 are a series of comparable views showing the air currents developed by various spun abrading-disc configurations as described more particularly next.

FIG. 7 shows a solid grinding disc in accordance with the prior art. FIG. 8 shows a sanding disc in accordance with the prior art but not solid, instead it showing the apertured ventilating configuration of the above referenced U.S. Pat. No. 6,007,414 —Van Osenbruggen. FIG. 9 shows the combination blowing backing plate and grinding disc 20 and 22 in accordance with the invention. Whereas the drawings of the invention have consistently shown the invention with six apertures, this is done so for sake of convenience of illustration of a single example only. Persons ordinarily skilled in the art would readily recognize routine variations to non-essential matters such as number of blowing and non-blowing apertures and pattern therefor as being incidental to the teachings of the invention, including optional elimination of all non-blowing apertures. Further routine variations would include the height of the fences or vanes 44 at their origins, the change along each vanes 44's spiral dimension at which it thins and/or flattens out (ie., the size of a "scoop" it defines), and the relative inboard to outboard location to establish the vanes 44 and corresponding blowing apertures 42. Naturally, the further outboard the vanes and blowing apertures 44 and 42 are established then a faster velocity will be expected relative to an inboard position and relative to a given or constant turning speed of the handheld shop tool T's output or drive shaft.

In view of the foregoing, FIG. 7 shows the mild currents induced by a solid grinding disc in accordance with the prior art and ejected tangentially along the disc's periphery. By way of background, experiments were conducted in order to make photographic record of the air currents illustrated by these FIGS. 7 through 9. An oily rag was set on fire. Then a shop tool outfitted successively with the three different types of combination abrading discs/backing plates and held up to the oily rag, and switched to ON to operate. Pictures were taken of the results. Hence, in the case of FIG. 7, the solid spinning disc induced a slight suction of the flame and smoke. The sucked-in smoke came into approximately the center of the spinning disc but then changed direction 90° and was ultimately tangentially-ejected along spiral trajectories from the edge of the disc.

FIG. 8 shows the moderate (in contrast to mild in connection with FIG. 7) suction currents induced by an apertured ventilating disc in accordance with the prior art. That is, the FIG. 8 version induced moderately more suction of the flame and smoke than the FIG. 7 version. Indeed, the smoke even carried through the ventilating apertures into the face of the worker.

FIG. 9 shows the strong blowing currents forced by the combination backing plate and disc 20 and 22 for blowing angled-grinding operations in accordance with the invention. Indeed, in the tests conducted, the invention blew out ("extinguished") the oily rag virtually the moment the shop tool was switched ON. The digital-camera obtained photographic record froze the action at the moment of operation and hence provided more meaningful analysis than real-time observation. Apparently, the invention produces such a blast of air as to separate the flame-propagation front from its source of fuel. Much more simply in other words, the invention just blows out the flame.

In use, the invention is advantageous for blowing away debris from the point of operation on the workpiece as well as to provide forced-air cooling of the workpiece.

Figures 10, 11:
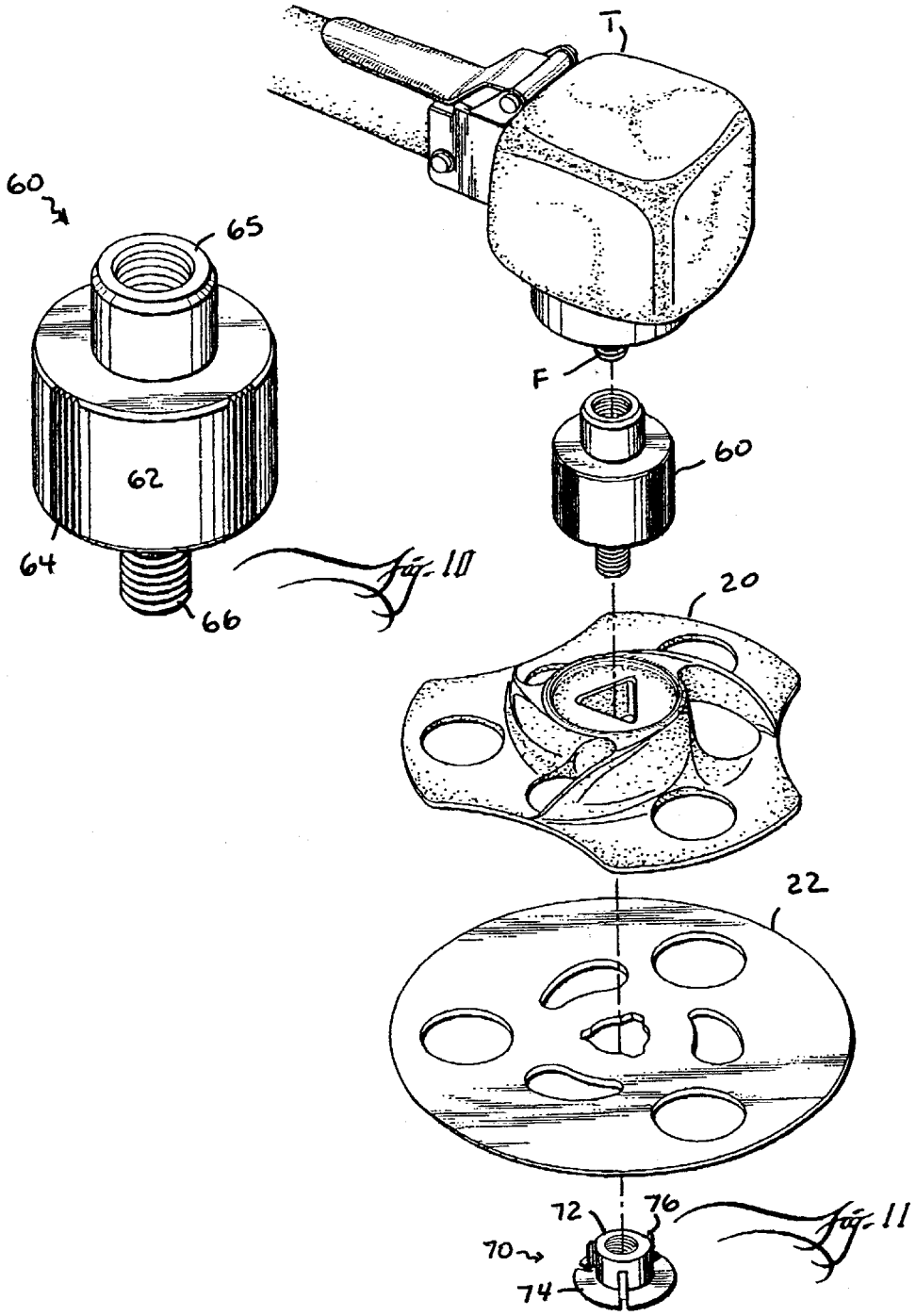
FIG. 10 is a perspective view of an adapter in accordance with the invention for insertion between a handheld grinding tool and combination abrasive disc/backing plate.
FIG. 11 is a reduced scale perspective view showing the adapter of FIG. 10 incorporated in use between a prior art handheld grinding tool and the inventive combination of a blowing angled grinding disc/backing plate, wherein FIG. 11 further includes illustration of a locking device in accordance with the invention for promoting a given alignment between the combination disc and backing plate.

FIG. 10 shows a further inventive improvement in accordance with the invention, in this instance comprising an adapter 60. Preferably the adapter 60 inserts between the handheld grinding tool T and the combination abrasive disc/backing plate 22/20 as shown in FIG. 11.

Figure 13:
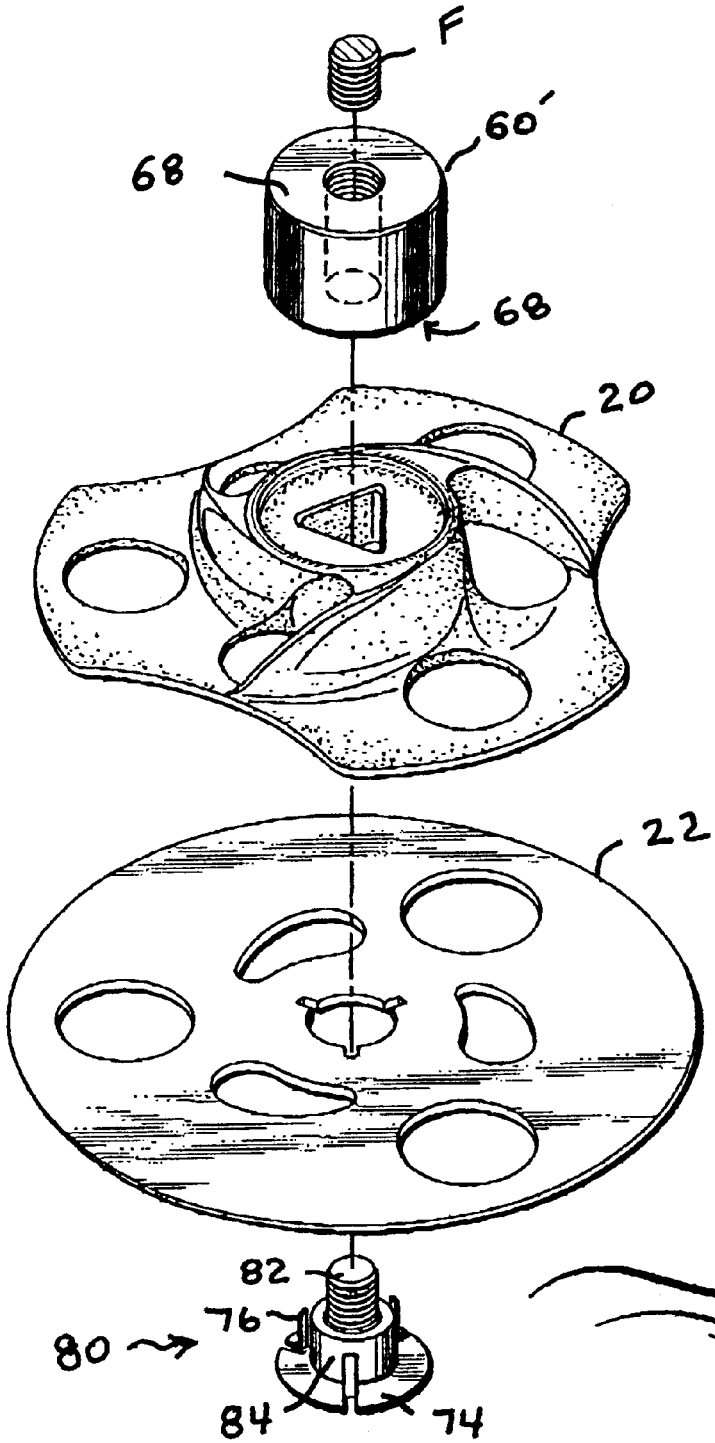
FIG. 13 is a perspective view comparable to FIG. 11 except that only the drive shaft of the handheld grinding tool is shown, the remainder of the handheld grinding tool being omitted from the view, and also except that the inventive adapter and locking device are changed to show an instance of a locking fastener and an internally threaded hole in the adapter therefor.
Figure 14:
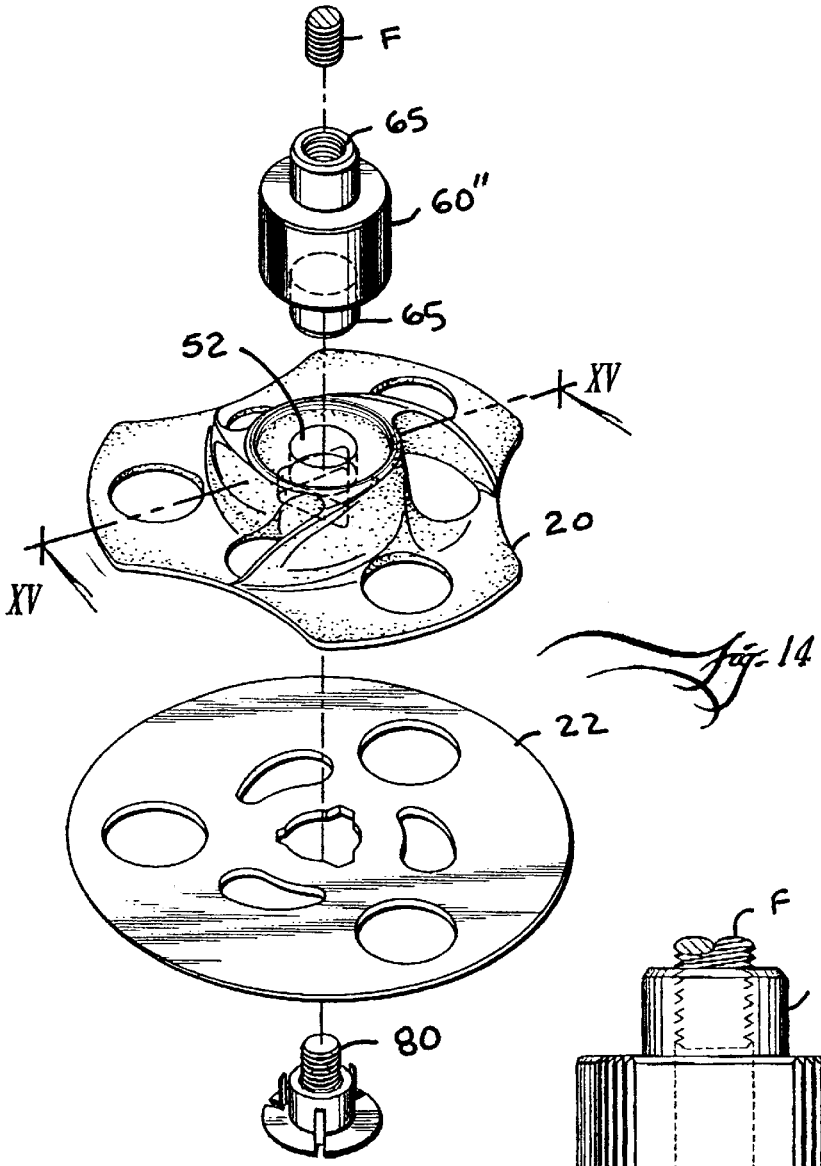
FIG. 14 is a perspective view comparable to FIG. 13 except showing modifications in the backing plate, adapter and locking fastener in accordance with the invention.
Figure 15:
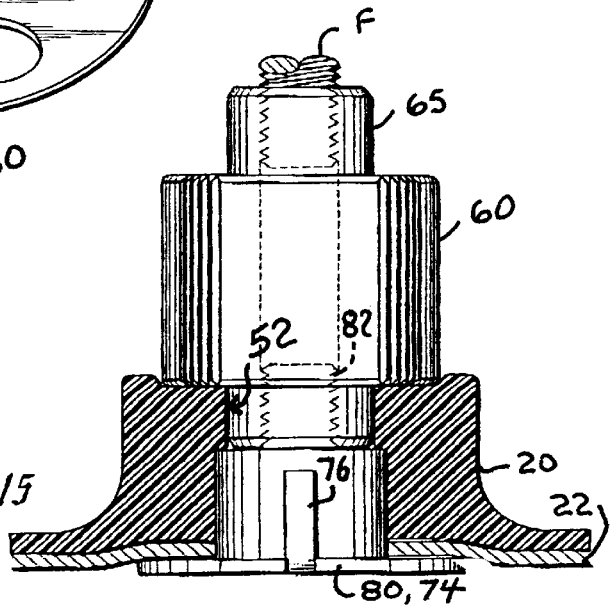
FIG. 15 is an enlarged scale, partial sectional view taken along line XV—XV in FIG. 14.

The adapter 60 has a main cylindrical body 62. The body 62 has grooves 64 to increase user manipulability. The main body 62 extends between spaced ends 65 and 66. One of the ends is provided with means 65 for attaching to the drive output shaft F of the handheld grinding tool T. In this case the drive output shaft F comprises a threaded stud and accordingly the tool end 65 of the adapter 60 comprises a matching threaded bore or, as preferred and shown in the drawing, an internally threaded boss 65. The other end can be configured in numerous ways for coupling the combination plate and disc. For example, FIGS. 10 and 11 show the locking end comprising a threaded stud 65 mimicking the threaded stud F of the handheld grinding tool T's drive output shaft. Alternatively, FIGS. 13–15 show other versions of the adapter 60' and 60" having other ends formed with internally threaded sockets 68 or bosses 65 comparable to the one end. Both the FIG. 13 version 60' of the adapter and the FIGS. 14 and 15 version 60" of the adapter are symmetric between opposite ends. Neither end is exclusively a tool end or locking end as each end is interchangeable in service of either coupling to the tool or securing the plate and disc 20 and 22 combination. In FIGS. 14 and 15, the tool is omitted from view except a relatively small portion of its drive output shaft F.

The adapter 60 provides many advantages. The adapter 60 serves as an extension between the tool T and plate/disc combination, giving a worker a gap to keep his or hands out of the way. The adapter 60 serves as an quick-connect, quick-disconnect feature. For example, the adapter 60, plate/disc combination and locking nut (or screw) can all be pre-assembled as a unit, and thereafter be attached and detached as a unit to and from the tool T in an efficient movement. Also, the adapter 60 serves a blowing plate/disc 20/22 combination in a special way in special cases.

By way of background, some pneumatic handheld grinding tools have their turbine exhaust aimed to jet out right along the output drive shaft F. These kinds of pneumatic tools work wonders with the blowing plate/disc 20/22 combination because they create a moderately high pressure zone immediately on the backside of the backing plate 20, which makes the work of the vanes 44 catching and scooping air even more efficient. In contrast, other kinds of pneumatic handheld grinding tools do not exhaust directly onto the backing plate 20, and indeed may set up air currents that actually create a moderately low pressure zone in the area of the backing plate 20. These kinds of tools seem to suck the wind out the vanes 44. The vanes 44 aren't as effective with these kinds of tools except, and this is where the adapter 60 is advantageous, if an adapter 60 is included. The adapter 60 places the plate/disc 20/22 combination some set distance away from the tool T and hence establishes the plate/disc 20/22 combination in an environment not as affected by the very local, low pressure environment surrounding the operating tool T. In other words, the adapter 60 moves away the plate/disc 20/22 combination from a disadvantageous low pressure environment that surrounds the output drive shaft F of some types of handheld grinding tools, to a more favorable position in a relatively more neutral environment.

To turn back to FIG. 11, it further includes depiction of a locking nut 70 in accordance with the invention. The locking nut 70 has inventive aspects for promoting a given alignment between the disc 22 and backing plate 20 so that all the apertures line up instead of being blocked.

Figure 12:
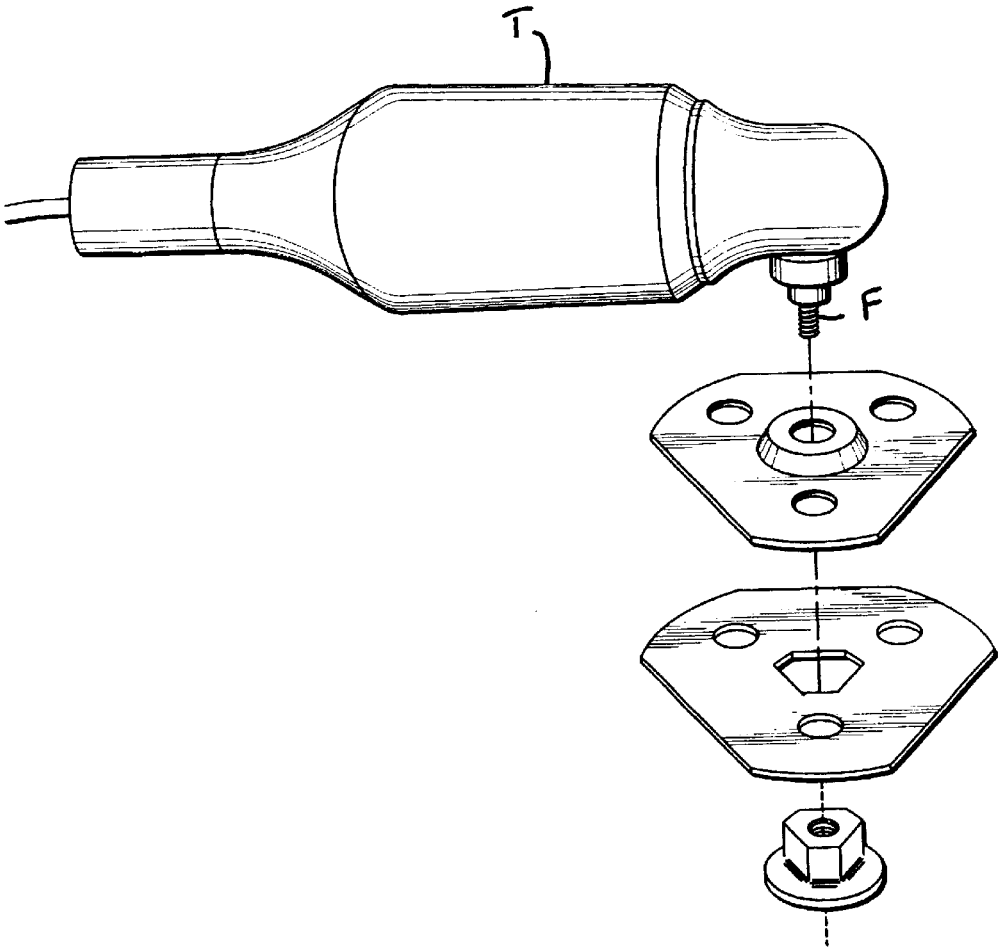
Fig. 12 ( PRIOR ART )
FIG. 12 is a perspective view of a locking nut in accordance with the prior art for aligning a backing plate and disc in accordance with the prior art provided with viewing apertures in accordance with the prior art.

FIG. 12 shows a locking nut in accordance with the prior art for aligning a prior art, apertured backing plate and disc, all which is disclosed by U.S. Pat. No. 6,277,012 —Halliley. The prior art locking nut has substantially a triangular shoulder, with rounded vertices, which mate with matching triangular center holes in the FIG. 12 backing plate and disc.

In FIG. 11, the inventive nut 70 is produced in a more economical construction. The threaded nut portion comprises simply an internally threaded pipe section 72. The pipe section 72 has an open end and a spaced end closed by an oversized sheet or plate head 74. The pipe 72 and head 74 are joined any suitable means including by welding or brazing and the like. The plate head 74 has three tabs 76 stamped out it by a sheet or plate metal operation referred to in the applicable technical art as "lancing." The three tabs 76 are produced from the original flat stock of the head 74 at a time of origin by a press operation which slices the sides of the tabs 76 and then folds them away to perpendicular positions from the plane of the remainder of the flat stock 74. FIG. 11 shows that the tabs 76 extend parallel to the internally-threaded pipe section 72 and are arranged angularly space apart 120° each on a diameter that is larger than the pipe 72's outside diameter. That way, the tabs 76 do not actually lie against the pipe 72. Indeed, the tabs 76 are sufficiently spaced away to get a suitable moment distance relative to the central axis and to the pipe 72's outside wall in order to resist the torque of the disc 22 from slipping out of its preferred alignment with the backing plate 20. That is, the friction of grinding tends to want to grab the disc 22 and slip it relative to the backing plate 20. The three tabs 76 act to prevent the disc 22 from slipping on the backing plate 20.

To facilitate the anti-slip function of the tabs 76, the plate 20 and disc 22 are formed with triangular central apertures sized such that registry among the disc 22, plate 20 and tabbed-nut 70 occurs only in three positions at every 120° apart, which corresponds to acceptable preferred positions.

In FIG. 13, substantially omitted from view is the handheld shop tool except for a broken away stub portion F of its drive output shaft. FIG. 13 is comparable to FIG. 11 except that the FIG. 13 version of the adapter 60' has a threaded socket 68 for both ends. Correspondingly, the locking device is not a nut 70 as shown in FIG. 11 but a threaded fastener 80. The FIG. 13 threaded fastener 80 has a terminal threaded end 82, a cylindrical shoulder 84, and then is attached to the same or substantially the same three-tabbed head 74 as attached to the pipe section 72 in FIG. 11. The disc 22 and backing plate 20 can be the same as in FIG. 11 or the disc 22 might be formed with a central hole as more particularly shown in FIG. 13.

FIG. 14 is a comparable to FIG. 13 except showing modifications in the adapter 60" and backing plate 20. The adapter 60" is provided with opposed internally-threaded bosses 65. The backing plate 20 has a central lumen formation 52 that is cylindrical partway through, changing to triangular the remainder. The cylindrical portion accommodates the boss end 65 of adapter 60" as better shown by FIG. 15. The triangular portion accommodates the three-tabbed head 74 of the locking fastener 80 as also better shown by FIG. 15. As FIG. 15 shows, the tabs 76 need not be very long to be good and satisfactory at both promoting alignment and preventing slip as well between the disc 22 and backing plate 20.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A combination abrasive disc and backing plate, comprising:

an abrasive disc having opposed first and second major surfaces, the first major surface being at least in part an abrasive surface, and having at least one non-concentric viewing aperture through the disc; and a backing plate having a bottom major surface which supports the abrasive disc and an opposed top surface, and correspondingly having at least one non-concentric viewing aperture through the plate such that coordinated alignment of the viewing apertures of the disc and plate allows observation of a workpiece collectively through the disc and plate during driven rotation thereof about a rotation axis substantially perpendicular to the bottom major surface;

wherein the plate's viewing aperture is bounded by a peripheral boundary and, during rotation of the plate, the plate's viewing aperture orbits the rotation axis such that the boundary is characterized by a leading portion and a spaced trailing portion, said plate further comprising a scooping formation on the top surface that is arranged around the trailing portion for scooping air from an environment above the plate's top surface and deflecting such in a current through the aligned viewing apertures of the disc and plate to provide an air current onto the workpiece; and wherein the plate's viewing aperture's boundary further comprises spaced inboard and outboard portions extending between and linking up the leading and trailing portions thereof, said scoop formation being arranged partly curling around the outboard portion as well.

2. The combination of claim 1 wherein said scoop formation projects partly covering the plate's viewing aperture, impeding viewing capability for the covered part while not impeding viewing capability for uncovered other part of the plate's viewing aperture.

3. The combination of claim 1 wherein the plate's top surface comprises a relatively thicker central hub portion that generally thins out in the outboard direction to a relatively thinner web portion that terminates in an outboard periphery, said plate's at least one viewing aperture being formed substantially in the web portion, and said scoop formation being formed as a fence having an origin in the hub portion and extending from such origin to a termination, progressively diminishing along the extension thereof to substantially disappear into the web portion by such termination.

4. The combination of claim 1 wherein the scoop formation includes a funnel shape for accelerating the current of air being deflected thereby.

5. A backing plate of the type for combining with an abrasive disc having at least one non-concentric viewing aperture through the disc; said backing plate comprising:

a bottom major surface adapted to support the abrasive disc and an opposed top surface, and correspondingly having at least one non-concentric viewing aperture through the plate such that coordinated alignment of the viewing apertures of the disc and plate allows observation of a workpiece collectively through the disc and plate during driven rotation thereof about a rotation axis substantially perpendicular to the bottom major surface;

wherein the plate's viewing aperture is partially adjoined by a scooping formation on the top surface that is arranged for scooping air from an environment above the plate's top surface and deflecting such in a current collectively through the aligned viewing apertures of the disc and plate to provide an air current onto the workpiece;

wherein the plate's viewing aperture is bounded by a peripheral boundary and, during rotation of the plate, the plate's viewing aperture orbits the rotation axis such that the boundary is characterized by a leading portion, a spaced trailing portion, and spaced inboard and outboard portions extending between and linking up the leading and trailing portions thereof, said scoop formation being arranged partly adjoining the trailing and outboard portions of the peripheral boundary; and wherein the plate's top surface comprises a relatively-thicker central hub portion that generally thins out in the outboard direction to a relatively-thinner web portion that terminates in an outboard periphery, said plate's at least one viewing aperture being formed substantially in the web portion, and said scoop formation being formed as a curling fence having an origin in the hub portion and extending from such origin to a termination, progressively diminishing along the extension thereof.

6. The backing plate of claim 5 wherein said scoop formation projects partly covering the plate's viewing aperture, impeding viewing capability for the covered part while not impeding viewing capability for uncovered other part of the plate's viewing aperture.

7. The backing plate of claim 5 wherein the scoop formation includes a funnel shape for accelerating the current of air being deflected thereby.

8. A combination abrasive disc and mounting system adapted for attaching to a rotary drive output which has the form of either an externally-threaded rod or an internally-threaded bore, comprising:

an abrasive disc and a separate backing plate characterized by having at least one set preferred angular alignment therebetween, and a fastener adapted to attach the disc and plate to a rotary drive output in the at least one set preferred angular alignment, wherein said fastener has a barrel formed with either an internally-threaded socket for screwing onto a rotary drive output's externally-threaded rod or else an externally-threaded stud for screwing into a rotary drive output's internally-threaded bore, said fastener further having a flanged head at one end of the barrel adapted to retain the disc in contact with the plate, said flanged head being formed with at least one prong spaced from and generally parallel to the barrel;

wherein both the disc and the plate have mounting apertures shaped to accomodate at least the barrel of the fastener as well as the at least one prong in order to achieve the mounting thereof to the rotary drive output in the at least one preferred set alignment.

9. The combination of claim 8 wherein the flanged head has at least three prongs and which prongs are provided equally spaced around the circumference of the barrel.

10. The combination of claim 9 wherein the plate is formed with mounting aperture shape that is a polygon characterized by a number of vertices corresponding to the number of prongs of the fastener, including a triangular shaped aperture for a three prong fastener.

11. The combination of claim 8 wherein the flanged head is produced by a lancing operation to produce the at least one prong.

12. The combination of claim 8 wherein the backing plate and the abrasive disc are provided with viewing apertures which align on the at least one preferred set alignment therebetween.

13. A grinding system comprising a rotary grinder and a combination abrasive disc and mounting system according to claim 8, further comprising an adapter extending between an input end and a spaced output end, said input end being formed with an internally-threaded socket for screwing onto an externally-threaded drive shaft or rod of the rotary grinder, and said output end being formed with either an externally-threaded rod or an internally-threaded bore for accommodating the fastener.

14. The grinding system of claim 13 wherein the disc and plate have viewing apertures, said disc being attached to the plate by utilization of the fastener such that the viewing apertures in both the plate and disc are aligned.

15. A backing plate adapted for combining with an abrasive disc having at least one non-concentric viewing aperture through the disc; said backing plate comprising:

a bottom surface adapted to support the abrasive disc and an opposed top surface, and having a corresponding viewing aperture through the plate such that coordinated alignment of the viewing apertures of the disc and plate allows observation of a workpiece collectively through the disc and plate during rotary drive thereof;

wherein the plate's viewing aperture is partially adjoined by a deflector formation on the top surface that is arranged for deflecting air from above the plate's top surface and forcing such in a current collectively through the aligned viewing apertures of the disc and plate and thereby afford a blowing current onto the workpiece for debris removal and workpiece cooling; and wherein the plate's top surface comprises a relatively-thicker central hub portion that beyond a transition generally thins out in the outboard direction to a relatively-thinner web portion that terminates in an outboard periphery, said plate's viewing aperture being formed substantially in the web portion, and said deflector formation being formed as a curling fence having an origin in the hub portion and extending from such origin to a termination, progressively diminishing along the extension thereof.

16. The backing plate of claim 15 wherein said deflector formation projects partly covering the plate's viewing aperture, impeding viewing capability for the covered part while not impeding viewing capability for uncovered other part of the plate's viewing aperture.

17. The backing plate of claim 15 wherein the wherein the plate's viewing aperture is bounded by a peripheral boundary and, during rotation of the plate, the plate's viewing aperture orbits the rotation axis such that the boundary is characterized by at least a leading portion and a spaced trailing portion, said deflector formation being arranged adjoining the trailing portion of the peripheral boundary.

18. The backing plate of claim 15 wherein the deflector formation includes a funnel shape for accelerating the current of air being deflected thereby.

* * * * *